US009897358B2

(12) United States Patent
Chen et al.

(10) Patent No.: US 9,897,358 B2
(45) Date of Patent: Feb. 20, 2018

(54) VAPOR COMPRESSION AIR-CONDITIONING SYSTEM EQUIPPED WITH ENERGY EFFICIENCY BOOSTER

(71) Applicants: Enjian Chen, Guangzhou (CN); Weijun Yu, Guangzhou (CN)

(72) Inventors: Enjian Chen, Guangzhou (CN); Xiaoli Xu, Guangzhou (CN); Xianlong Wang, Guangzhou (CN)

( * ) Notice: Subject to any disclaimer, the term of this patent is extended or adjusted under 35 U.S.C. 154(b) by 54 days.

(21) Appl. No.: 14/963,242

(22) Filed: Dec. 9, 2015

(65) Prior Publication Data

US 2016/0091233 A1 Mar. 31, 2016

Related U.S. Application Data

(63) Continuation-in-part of application No. PCT/CN2014/078951, filed on May 30, 2014.

(30) Foreign Application Priority Data

Jul. 22, 2013 (CN) ..... 2013 1 0309724

(51) Int. Cl.
*F25B 45/00* (2006.01)
*F25B 13/00* (2006.01)

(52) U.S. Cl.
CPC ..... *F25B 45/00* (2013.01); *F25B 13/00* (2013.01); *F25B 2339/047* (2013.01)

(58) Field of Classification Search
CPC ..... F25B 45/00; F25B 13/00; F25B 30/00; F25B 2339/047; F01P 7/16; G05D 23/022
USPC ..... 62/324.1, 498
See application file for complete search history.

(56) References Cited

U.S. PATENT DOCUMENTS 5,137,079 A * 8/1992 Anderson ..... F01P 7/16 165/104.33
6,101,822 A * 8/2000 Groves ..... B60H 1/00585 62/149
2004/0003787 A1* 1/2004 Allen ..... F01L 9/02 123/90.12
2005/0044865 A1* 3/2005 Manole ..... F25B 1/10 62/149
2009/0159076 A1* 6/2009 Zheng ..... F24D 11/0221 126/615
2013/0031922 A1* 2/2013 Heyl ..... B60H 1/00907 62/222

OTHER PUBLICATIONS

Translated abstract of CN 102072591 of Cai et al.*
Translation of CN 102072591 of Cai et al.*
Translated basic abstract of CN 102072591 of Cai et al.*

* cited by examiner

*Primary Examiner* — Mohammad M Ali
(74) *Attorney, Agent, or Firm* — Wayne & Ken, LLC; Tony Hom

(57) ABSTRACT

A vapor compression air-conditioning system equipped with an energy efficiency booster (6) in a working fluid circulation loop of the system. The energy efficiency booster (6) comprises a variable volume container (61) and an actuator mechanism (62) for changing the volume of the container. The energy efficiency booster (6) is capable of utilizing the variable volume container (61) to receive a working fluid in the loop of the system and to change the average density of the working fluid, thus allowing the system to be at the optimal energy efficiency ratio, and improving the operational performance of the air-conditioning system.

6 Claims, 6 Drawing Sheets

VAPOR COMPRESSION AIR-CONDITIONING SYSTEM EQUIPPED WITH ENERGY EFFICIENCY BOOSTER

CROSS-REFERENCE TO RELATED APPLICATIONS

This application is a continuation-in-part of International Patent Application No. PCT/CN2014/078951 with an international filing date of May 30, 2014, designating the United States, now pending, and further claims priority benefits to Chinese Patent Application No. 201310309724.X filed Jul. 22, 2013. The contents of all of the aforementioned applications, including any intervening amendments thereto, are incorporated herein by reference.

TECHNICAL FIELD

The present invention pertains to the field of refrigerating and heating technologies, and in particular, relates to a vapor compression air-conditioning system equipped with an energy efficiency booster.

BACKGROUND

The vapor compression air-conditioning system includes an air-conditioning/heat pump system, a refrigeration system, a heat pump system, and a heat pump water heater system. In essence, a working process of the vapor compression air-conditioning system is as follows: The refrigerant of the vapor compression air-conditioning system absorbs heat from a low-temperature medium (for example, indoor or outdoor air), and after the temperature is increased by a compressor through compression, heat is released to a high-temperature medium (for example, outdoor or indoor air). To achieve a most economical and efficient operational effect, a condensing temperature of the refrigerant of the vapor compression air-conditioning system should be higher than the temperature of the high-temperature medium by a minimum reasonable temperature difference .DELTA.Tk, while an evaporating temperature of the refrigerant should be lower than the temperature of the low-temperature medium by a minimum reasonable temperature difference .DELTA.Te.

In a design condition, the foregoing requirements may be basically fulfilled, and in this case, the system reaches an optimal energy efficiency ratio and a maximum working capability. However, in an actual operation process, the foregoing ideal requirements always cannot be met.

In the conventional air-conditioning/heat pump system, to respond to condition changes, there are mainly the following two performance adjustment means:

(1) Variable-frequency adjustment: Variable-frequency adjustment is mainly to achieve an objective of changing the flux of the refrigerant and power consumption of the compressor by changing a rotational speed of the compressor. Thereby, in a situation in which an air temperature is not high, an objective of energy saving may be achieved by property decreasing the rotational speed of the compressor.

(2) Adjustment of expansion valves, including a thermal expansion valve, an electronic expansion valve, and the like. An adjustment principle thereof is to achieve an objective of changing the flux of the refrigerant and an expansion ratio by changing the throttling area of the expansion valve.

Neither of the foregoing two adjustment means can change an average density of the refrigerant in the system, or in other words, a refrigerant charge. It is proved by both theory and experiment that in each condition, there is an optimal refrigerant charge. With this optimal charge, the system works in an optimal state, and has an optimal energy efficiency ratio. When the system deviates from the design condition, the average density of the refrigerant cannot be changed by using the foregoing two adjustment means, and therefore, the system can hardly work in a state of an optimal energy efficiency ratio (EER or COP).

When a unit switches between the refrigeration condition and the heat pump condition, the foregoing problem is especially severe. For example, in the refrigeration condition in summer, an ambient temperature range of the system is 27.degree. C. (indoors) to 35.degree. C. (outdoors); in the heat pump condition in winter, an ambient temperature range of the system is 20.degree. C. (indoors) to 2.degree. C. (outdoors). In the foregoing temperature conditions, during refrigerating in summer, the condensing temperature of the refrigerant should be set to 50.degree. C. properly, and the evaporating temperature of the refrigerant should be set to 12.degree. C.; during heating in winter, the condensing temperature of the refrigerant should be decreased to 35.degree. C., and the evaporating temperature of the refrigerant should be decreased to −13.degree. C. Apparently, in the two conditions, there is a difference of 20.degree. C. between working temperatures of the refrigerant. Because a gaseous refrigerant has different densities in different temperatures, a difference of 20.degree. C. causes a density difference of the gaseous refrigerant to be greater than 50%. That is, in the refrigeration condition and the heat pump condition, there is a great difference between optimal refrigerant charges in the system. Apparently, the conventional air-conditioning system can hardly adapt to this situation. If the refrigeration condition is considered in the charging refrigerant of the conventional air-conditioning system, then the refrigerant in the heat pump condition will be too excessive. To reduce this difference, in design of the conventional air-conditioning system, the heat exchanging area of the indoor heat exchanger is decreased intentionally, and a temperature difference of the indoor heat exchanger is increased. Thereby, during refrigerating in summer, the evaporating temperature of the refrigerant is decreased from 12.degree. C. to 5.degree. C., while during heating in winter, the condensing temperature is increased from 35.degree. C. to 43.degree. C. In this case, the difference between working temperatures of the refrigerant in the two conditions in winter and summer is reduced to approximately 3.degree. C., and the difference between optimal refrigerant charges is decreased, at a cost of a decrease of the design energy efficiency ratio, which is decreased from 4 to approximately 3.

Even during the operation in the refrigeration-only condition or the heat pump condition, the conventional air-conditioning system deviates from the design condition in most of time. The indoor temperature is decreased slowly just after the air-conditioning system is started; however, after the indoor temperature becomes stable, the outdoor temperature may change with time, and the refrigerant charge of the conventional air-conditioning system cannot be precisely adjusted accordingly. This indicates that the refrigerant charge of the conventional air-conditioning system is not optimal in most of time.

SUMMARY

In view of the problem that a system can hardly work in a state of an optimal energy efficiency ratio (EER or COP) because an average density of a refrigerant is fixed in the prior art, the present invention provides a technical solution in which the volume of the circulation loop in a vapor compression air-conditioning system is continuously adjustable, so that an average density of the refrigerant in the system changes from a fixedly unchanged state to an adjustable state. A change of the volume of the circulation loop indicates a change of the average density of the refrigerant. When the average density of the circulated refrigerant is increased, if other conditions are unchanged, both a condensing temperature and an evaporating temperature of the circulated refrigerant are increased, and vice versa. This provides a new adjustment means for the operation of the air-conditioning system, and thereby effectively increases the energy efficiency ratio of the air-conditioning system.

To solve the foregoing problem, the present invention adopts the following technical solution:

A vapor compression air-conditioning system equipped with an energy efficiency booster includes a refrigerant circulation loop formed by a compressor, a condenser, an expansion valve, an evaporator, and a pipeline that connects the foregoing components in sequence, where an energy efficiency booster is connected to the refrigerant circulation loop, and the energy efficiency booster includes a variable-volume container and an actuator for changing the volume of the container.

Further, the system includes a four-way valve, where when the four-way valve is connected to the refrigerant circulation loop, switching the four-way valve may cause the circulation loop to operate in a refrigeration manner or a heat pump manner.

The condenser is further connected to a water tank and a circulating pump by using a pipe to form a water heating circulation loop.

More preferably, a position for connecting the variable-volume container to the refrigerant circulation loop is disposed at a circulation pipe at an outlet of the compressor.

Specifically, the variable-volume container is a flexible corrugated pipe, where two ends of the corrugated pipe are respectively sealed by a bottom plate, a bottom plate at one end of the corrugated pipe is connected to the pipe of the refrigerant circulation loop by using a connection pipe, and a bottom plate at another end of the corrugated pipe is connected to the actuator. The actuator is formed by a lead screw-nut pair, where an outer circle of a nut is a worm wheel, a worm matching the worm wheel is driven by a motor, and one end of the lead screw is fixedly connected to the bottom plate of the corrugated pipe.

In the air-conditioning system equipped with an energy efficiency booster in the present invention, an energy efficiency ratio of the system may be increased significantly, an energy efficiency ratio in a design condition may reach approximately 4, and a seasonal energy efficiency ratio of the system can exceed an energy efficiency ratio in a design condition, so that operational performance of the air-conditioning system is improved significantly.

The following describes the present invention in detail with reference to accompanying drawings and specific embodiments.

DESCRIPTION OF EMBODIMENTS

Figure 1:
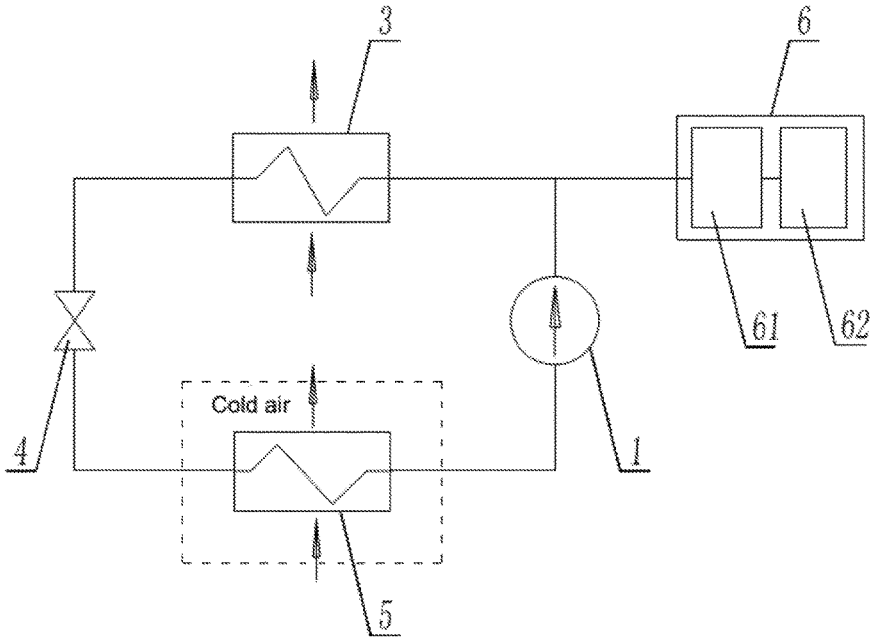
FIG. 1 is a schematic diagram of an air-conditioning refrigeration-only system according to Embodiment 1.

FIG. 1 is a schematic diagram of an air-conditioning refrigeration-only system according to Embodiment 1. The system includes a refrigerant circulation loop formed by a compressor 1, a condenser (outdoor unit) 3, an expansion valve 4, an evaporator (indoor unit) 5, and a pipeline that connects the foregoing components in sequence. An energy efficiency booster 6 is connected to the refrigerant circulation loop, and the energy efficiency booster is formed by a variable-volume container 61 and an actuator 62 for changing the volume of the container. In a preferred embodiment, a position for connecting the variable-volume container 61 to the refrigerant circulation loop is disposed at a circulation pipe at an outlet of the compressor 1. Because a circulated refrigerant in this position has a high pressure and a great density, a slight change of the volume of the variable-volume container 61 may cause a great impact on an average density of the circulated refrigerant in the circulation loop of the system, and adjustment sensitivity is high. Of course, the variable-volume container may be connected to other positions in the circulation loop of the system, or a plurality of variable-volume containers may be connected to the circulation loop.

When an outdoor air temperature in summer is decreased, a condensing temperature of the refrigerant is also decreased. Correspondingly, a condensing pressure and density of the refrigerant are decreased, and the amount of the refrigerant in the circulation loop is excessive, which causes a decrease of an energy efficiency ratio. In this case, the volume of the variable-volume container 61 may be increased slightly, so that the average density of the refrigerant in the circulation loop is decreased, so that the amount of the refrigerant in the circulation loop reaches an optimal value. In this case, the system has an optimal energy efficiency ratio and a maximum refrigeration capability. Still further, on condition that a rotational speed of the compressor keeps unchanged, because the average density of the refrigerant in the circulation loop is adjustable, the flux of the refrigerant passing through the compressor is also adjustable, and thereby an objective of implementing a variable-volume air-conditioning system by using a conventional compressor with a fixed rotational speed is achieved. Therefore, the present invention has a prospect of replacing a variable-frequency air-conditioning system.

Figure 2:
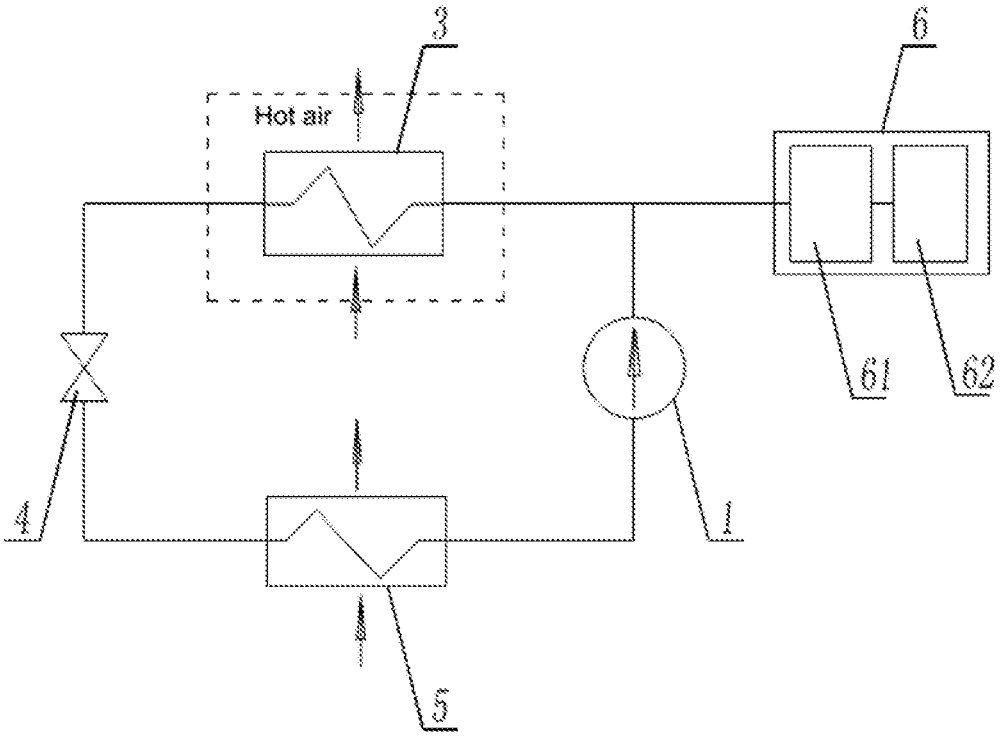
FIG. 2 is a schematic diagram of a heat pump only system according to Embodiment 2.

FIG. 2 is a schematic diagram of a heat pump only system according to Embodiment 2. The system includes a refrigerant circulation loop formed by a compressor 1, a condenser (indoor unit) 3, an expansion valve 4, an evaporator (outdoor unit) 5, and a pipeline that connects the foregoing components in sequence. An energy efficiency booster 6 is connected to the refrigerant circulation loop, and the energy efficiency booster is formed by a variable-volume container 61 and an actuator 62 for changing the volume of the container. In a preferred embodiment, a position for connecting the variable-volume container 61 to the refrigerant circulation loop is disposed at a circulation pipe at an outlet of the compressor 1. Because a circulated refrigerant in this position has a high pressure and a great density, a slight change of the volume of the variable-volume container 61 may cause a great impact on an average density of the refrigerant in the circulation loop of the system, and adjustment sensitivity is high. Of course, the variable-volume container may be connected to other positions in the circulation loop of the system, or a plurality of variable-volume containers may be connected to the circulation loop.

When an outdoor air temperature in winter is decreased, the volume of the variable-volume container 61 may be increased slightly, so that the average density of the refrigerant in the circulation loop is decreased. In this case, an evaporating temperature of the refrigerant is also decreased, and the evaporator maintains a reasonable optimal temperature difference for heat transfer. In this case, the system implements heating with high efficiency at a low temperature, without basically decreasing an energy efficiency ratio and a maximum heating capability.

Figure 3:
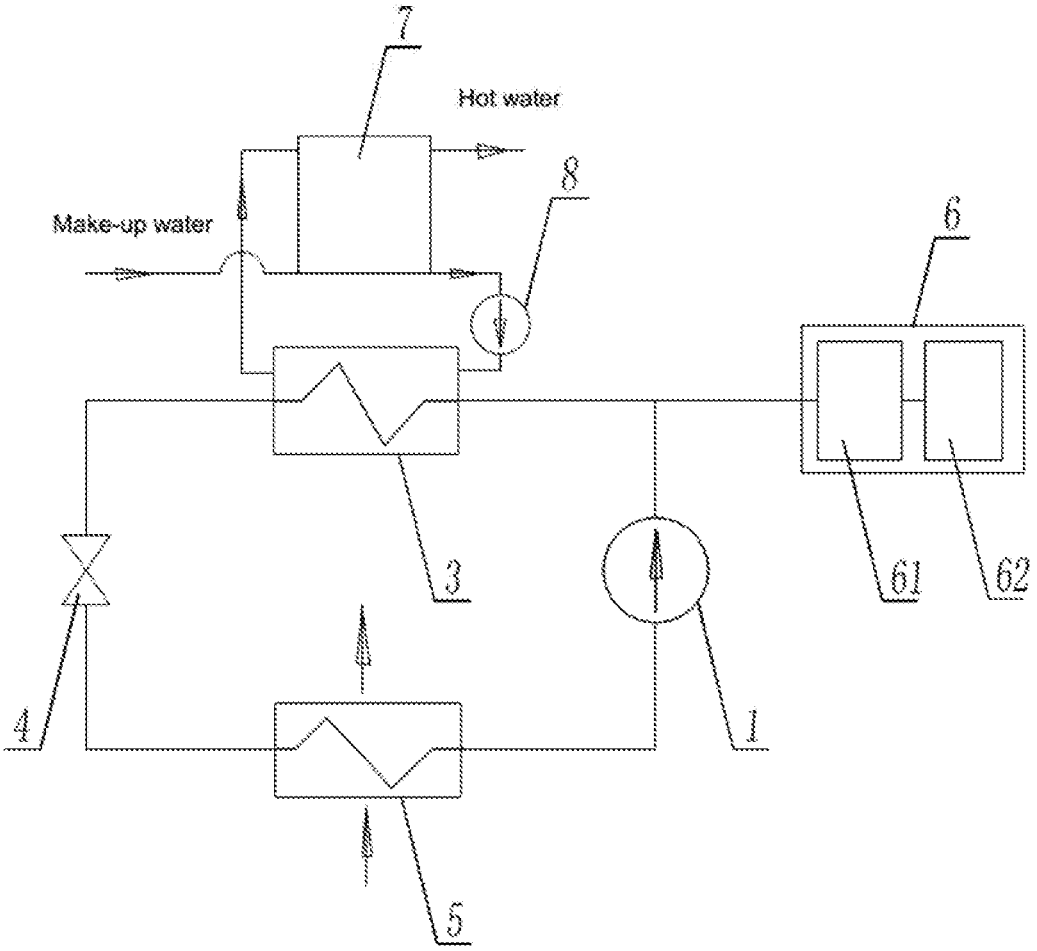
FIG. 3 is a schematic diagram of a heat pump water heater system according to Embodiment 3.

FIG. 3 is a schematic diagram of a heat pump water heater system equipped with an energy efficiency booster according to Embodiment 3. The system includes a refrigerant circulation loop formed by a compressor 1, a condenser 3, an expansion valve 4, an evaporator 5, and a pipeline that connects the foregoing components in sequence, where the condenser 3, a water tank 7, and a circulating pump 8 further form a water heating circulation loop. An energy efficiency booster 6 is connected to the refrigerant circulation loop, and the energy efficiency booster is formed by a variable-volume container 61 and an actuator 62 for changing the volume of the container. In a preferred embodiment, a position for connecting the variable-volume container 61 to the refrigerant circulation loop is disposed at a circulation pipe at an outlet of the compressor 1. Because a circulated refrigerant in this position has a high pressure and a great density, a slight change of the volume of the variable-volume container 61 may cause a great impact on an average density of the refrigerant in the circulation loop of the system, and adjustment sensitivity is high. Of course, the variable-volume container may be connected to other positions in the circulation loop of the system, or a plurality of variable-volume containers may be connected to the circulation loop.

Due to working characteristics of the heat pump water heater, a water temperature is increased gradually. For example, at the beginning of heating, the water temperature is 10.degree. C., and after the heating is completed, the water temperature is increased to 55.degree. C., and therefore, a condensing temperature of the refrigerant of the heat pump water heater should also be increased from 25.degree. C. to 65.degree. C. correspondingly. If an environment-friendly refrigerant 134*a* is used, a density of a gaseous refrigerant at 25.degree. C. is 32 kg/m3, and a density of the gaseous refrigerant at 65.degree. C. is 100 kg/m3, which is over three times as high as that at 25.degree. C. A fixed refrigerant charge in a conventional heat pump water heater cannot adapt to this situation. At the beginning of heating, the refrigerant is severely excessive, and after the heating is completed, the refrigerant is insufficient. This apparently decreases an energy efficiency ratio of the heat pump water heater. This problem can be solved by using the present invention. In a whole heating process, the volume of the variable-volume container 61 may be decreased gradually, that is, the average density of the refrigerant in the circulation loop is increased gradually, so that the condenser is always in an optimal working state, and thereby the heat pump water heater has an optimal energy efficiency ratio and a maximum working capability.

Figure 4:
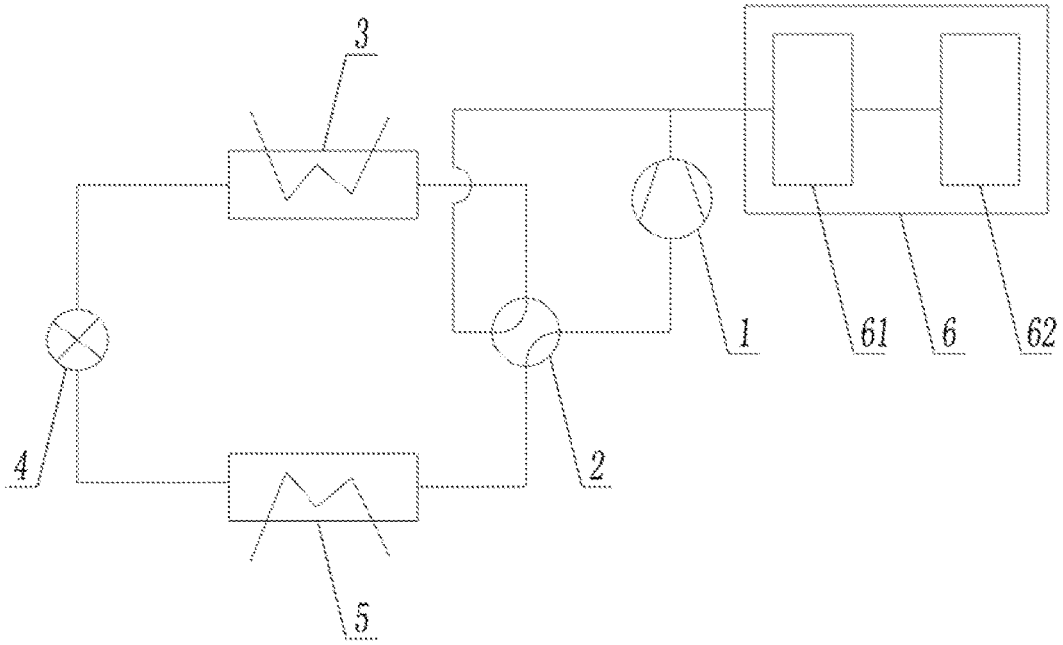
FIG. 4 is a schematic diagram of an air-conditioning refrigeration and heat pump system according to Embodiment 4.

FIG. 4 is a schematic diagram of an air-conditioning/heat pump system according to Embodiment 4. The system includes a refrigerant circulation loop formed by a compressor 1, a four-way valve 2, a condenser 3, an expansion valve 4, an evaporator 5, and a pipeline that connects the foregoing components in sequence. Switching the four-way valve 2 may cause the circulation loop to operate in an air-conditioning refrigeration manner or a heat pump manner. An energy efficiency booster 6 is connected to the refrigerant circulation loop, and the energy efficiency booster is formed by a variable-volume container 61 and an actuator 62 for changing the volume of the container. In a preferred embodiment, a position for connecting the variable-volume container 61 to the refrigerant circulation loop is disposed at a circulation pipe at an outlet of the compressor 1. Because a circulated refrigerant in this position has a high pressure and a great density, a slight change of the volume of the variable-volume container 61 may cause a great impact on an average density of the refrigerant in the circulation loop of the system, and adjustment sensitivity is high. Of course, the variable-volume container may be connected to other positions in the circulation loop of the system, or a plurality of variable-volume containers may be connected to the circulation loop.

When a condition of the system switches from an air-conditioning refrigeration condition (for example, a condensing temperature of the refrigerant is 50.degree. C., and an evaporating temperature of the refrigerant is 12.degree. C.) to a heat pump condition (for example, the condensing temperature of the refrigerant is 35.degree. C., and the evaporating temperature of the refrigerant is −10.degree. C.), the volume of the variable-volume container 61 could be increased, so that the average density of the refrigerant in the circulation loop is decreased. Thereby, the condensing temperature of the refrigerant is gradually decreased from 50.degree. C. to 35.degree. C., the corresponding evaporating temperature of the refrigerant is decreased from 12.degree. C. to approximately −10.degree. C. condition switching is implemented, and an energy efficiency ratio of the system is maintained to be approximately 4, which is over 10% higher than an optimal energy efficiency ratio of a conventional air-conditioning system. Conversely, in switching from a heating condition to a refrigeration condition, the volume of the variable-volume container 61 may be decreased, so that the refrigerant charge adapts to the change of the working temperature of the refrigerant.

If the present invention is combined with expansion valve adjustment or variable-frequency adjustment, comprehensive precise adjustment could be implemented on the air-conditioning/heat pump system, and thereby both .DELTA.Tk and .DELTA.Te may be adjusted to an optimal value in each condition. In this case, the energy efficiency ratio of the system reaches a maximum value in the condition.

Figure 5:
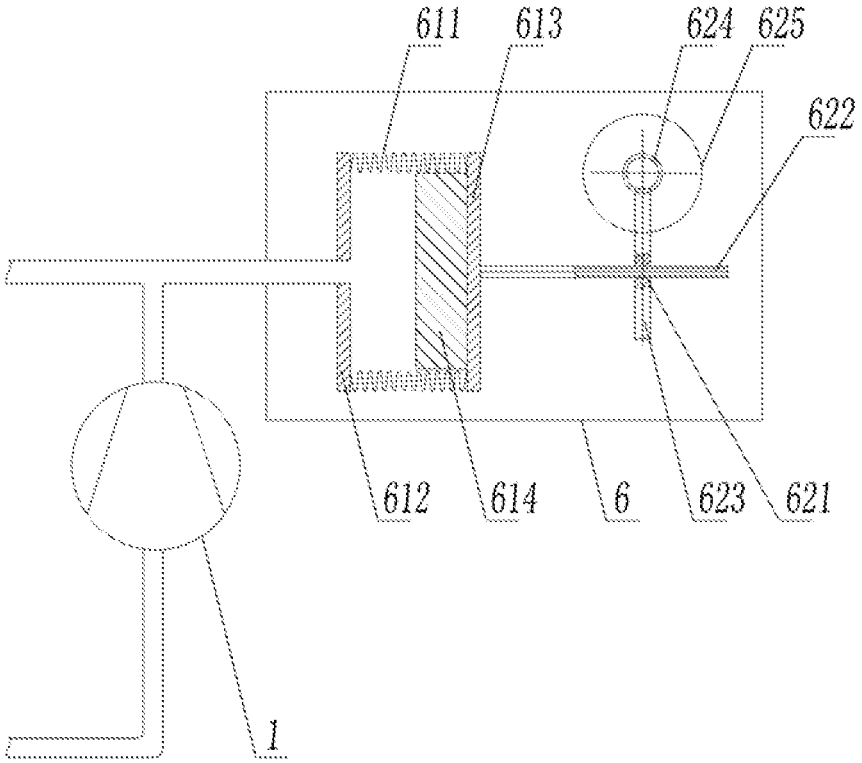
FIG. 5 is a schematic diagram of an energy efficiency booster according to an embodiment.

FIG. 5 is a schematic diagram of an energy efficiency booster in a vapor compression air-conditioning system equipped with the energy efficiency booster according to an embodiment. As shown in the figure, a variable-volume container 61 is a flexible corrugated pipe 611, where two ends of the corrugated pipe are respectively sealed by first bottom plate 612 and second bottom plate 613. One end of the bottom plate 612 is connected to the pipe of the refrigerant circulation loop by using a connection pipe, and the second bottom plate 613 is connected to the actuator 62.

The actuator 62 is formed by a lead screw-nut pair, where an outer circle of a nut 621 is a worm wheel 623, a worm 624 matching the worm wheel is driven by a motor 625, and one end of the lead screw 622 is fixedly connected to the bottom plate of the corrugated pipe. When the motor 625 rotates forward or backward, the worm wheel and the nut 621 also rotate forward or backward, so that the lead screw 622 moves forward or backward, driving the bottom plate 613 of the container of the corrugated pipe to move, thereby achieving an objective of changing the volume of the container.

To decrease a dead volume of the container of the corrugated pipe, a cylinder 614 is welded at an inner side of the second bottom plate 613 at one end of the corrugated pipe, where a diameter of the cylinder is slightly smaller than an inner diameter of the corrugated pipe, and a length of the cylinder is slightly greater than a length of the completely compressed corrugated pipe.

For a compressor that is a 2 kW hermetic scroll refrigerant compressor, the inner diameter of the corrugated pipe is 20 cm, and the diameter of the cylinder 614 is 19.8 cm. When the length of the completely compressed corrugated pipe is 10 cm, the length of the cylinder is 10.1 cm. A distance between an end face of the cylinder 614 and an end face of the inner side of the front bottom plate 613 changes within a range of 0 cm to 15 cm, and the corresponding length of the corrugated pipe changes within a range of 10 cm to 25 cm.

In addition to the corrugated pipe and a mechanically driven mechanism thereof in the foregoing embodiment, the energy efficiency booster in the present invention may have other structural forms. For example, a piston cylinder cooperates with a hydraulically driven mechanism, and the hydraulic driven mechanism drives a piston to move in the cylinder to change the amount of a refrigerant in the cylinder. The variable-volume container may further adopt a bellow-type, a special deformable composite material, or the like.

Figure 6:
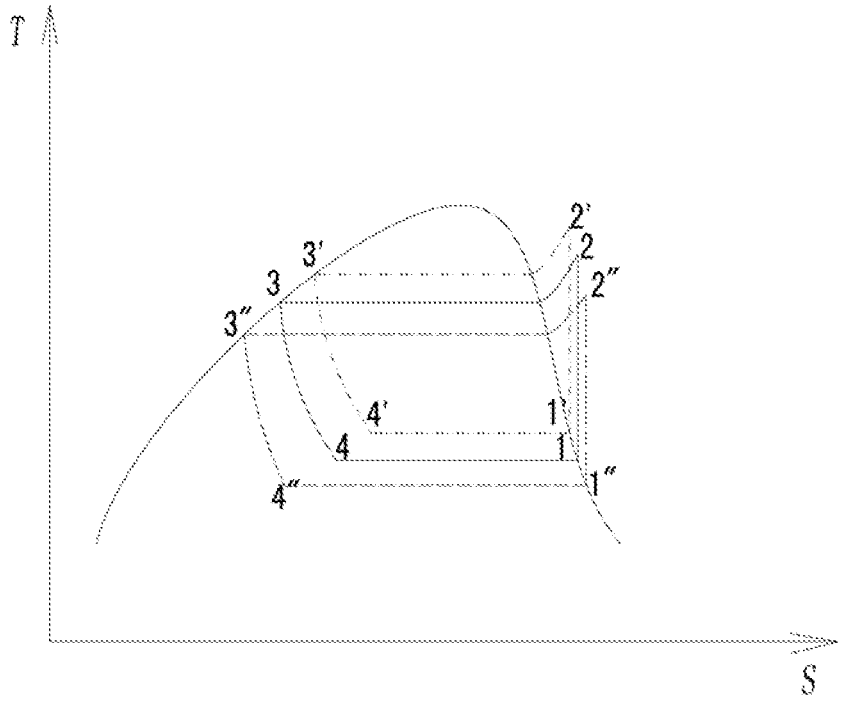
FIG. 6 is a temperature-entropy chart of the cyclic process of the refrigerant in an air conditioning system equipped with an energy efficiency booster.

FIG. 6 is a temperature-entropy chart of the cyclic process of the refrigerant in an air-conditioning system equipped with an energy efficiency booster, where a horizontal coordinate S represents an entropy value, and a vertical coordinate T represents a temperature value. In fact, the adjustment of changing the volume of the container is changing an average density of a circulated refrigerant, so that a condensing temperature and an evaporating temperature of the refrigerant are both increased or decreased. A dosed curve 1-2-3-4 indicated by a solid line in the figure is a cyclic curve in a design condition, where 1-2 indicates a refrigerant compression process, 2-3 indicates a refrigerant condensing process, 3-4 indicates a refrigerant expansion process, and 4-1 indicates a refrigerant evaporation process. When the volume of the variable-volume container is decreased, the average density of the circulated refrigerant is increased, and the dosed cyclic curve 1-2-3-4 in the figure shifts up, as shown in a curve 1'-2'-3'-4'. When the volume of the variable-volume container is increased, the average density of the circulated refrigerant is decreased, and the closed cyclic curve 1-2-3-4 in the figure shifts down, as shown in a curve 1"-2"-3"-4". In this case, because the rotational speed of the compressor and the opening of the expansion valve are both unchanged, a compression ratio of the circulated refrigerant does not change significantly. This is a basic difference between the adjustment means the present invention and a conventional adjustment means changing an expansion ratio or a compression ratio. The two different adjustment means could be combined, so that the air-conditioning system can precisely meet operational requirements in various conditions, and that an energy efficiency ratio of the system is always maintained to be an optimal value.

We claim:

1. A vapor compression air-conditioning system equipped with an energy efficiency booster, comprising:

a compressor;

a condenser;

an expansion valve;

an evaporator; and a pipeline that connects the foregoing components in sequence;

wherein an energy efficiency booster is connected to the refrigerant circulation loop, and the energy efficiency booster comprises a variable-volume container and an actuator for changing the volume of the container; a connecting position of the variable-volume container and the refrigerant circulation loop is arranged at a circulation pipe of an outlet of the compressor; the variable-volume container is a flexible corrugated pipe; two ends of the corrugated pipe are respectively sealed by a first bottom plate and a second bottom plate; and the first bottom plate is connected with the refrigerant circulation loop by a connection pipe, and the second bottom plate is connected to the actuator.

2. The vapor compression air-conditioning system of claim 1, further comprising a four-way valve; wherein when the four-way valve is connected to the refrigerant circulation loop, the four-way valve is switched to cause the circulation loop to operate in a refrigeration manner or a heat pump manner, the volume of the variable-volume container is increased while the vapor compression air-conditioning system works from an air-conditioning refrigeration condition to a heat pump condition; the volume of the variable-volume container is decreased while the vapor compression air-conditioning system works from a heat pump condition to an air-conditioning refrigeration condition.

3. The vapor compression air-conditioning system of claim 1, wherein the condenser is further connected to a water tank and a circulating pump.

4. The vapor compression air-conditioning system of claim 1, wherein the actuator comprises a motor, a nut, a lead screw, a worm wheel and a worm; wherein an outer circle of the nut is the worm wheel; a worm matching the worm wheel is driven by a motor, and one end of the lead screw is fixedly connected to the bottom plate of the corrugated pipe.

5. The vapor compression air-conditioning system of claim 1, wherein a cylinder is welded at an inner side of the bottom plate at one end of the corrugated pipe; wherein a diameter of the cylinder is slightly smaller than an inner diameter of the corrugated pipe; and a length of the cylinder is slightly greater than a length of the completely compressed corrugated pipe.

6. The vapor compression air-conditioning system equipped with an energy efficiency booster according to claim 2, wherein a position for connecting the variable-volume container (61) to the refrigerant circulation loop is disposed at a circulation pipe at an outlet of the compressor (1).

* * * * *